US005444215A

United States Patent [19]

Bauer

[11] Patent Number: 5,444,215

[45] Date of Patent: Aug. 22, 1995

[54] HAIRDRESSING DEVICE WITH FIRST AND SECOND BLOWERS

[76] Inventor: Rudolf Bauer, Konigstrasse 17, D-7000 Stuttgart 17, Germany

[21] Appl. No.: 95,250

[22] Filed: Jul. 23, 1993

Related U.S. Application Data

[63] Continuation of Ser. No. 752,486, filed as PCT/EQ90/00355, Mar. 3, 1990, published as WO90/10399, Sep. 20, 1990, abandoned.

[30] Foreign Application Priority Data

Mar. 3, 1989 [DE] Germany ..... 39 07 418.8

[51] Int. Cl.[6] ..... A45D 2/36; A45D 20/00

[52] U.S. Cl. ..... 219/222; 392/384; 392/380; 132/212; 132/269; 132/229

[58] Field of Search ..... 219/222–226; 392/379–385; 132/211, 212, 112, 229, 269

[56] References Cited

U.S. PATENT DOCUMENTS

| | | | |
|---|---|---|---|
| 2,173,102 | 9/1939 | Frank | 392/380 |
| 2,224,876 | 12/1940 | Matys | 34/100 |
| 2,437,366 | 3/1948 | Thomas | 392/380 X |
| 2,471,657 | 5/1949 | Saye | 34/99 |
| 2,527,745 | 10/1950 | Lawrence | 34/100 |
| 3,241,560 | 3/1966 | Willat | 392/382 X |
| 3,503,138 | 3/1970 | Fuchs et al. . | |
| 4,210,162 | 7/1980 | Dreyer et al. | 132/271 |
| 4,409,998 | 10/1983 | Bauer | 34/96 |
| 4,706,326 | 11/1987 | Romani . | |
| 4,910,381 | 3/1990 | Recchle | 219/222 |
| 4,935,643 | 6/1990 | Reichle et al. | 34/101 X |
| 4,977,690 | 12/1990 | Davis | 34/100 X |

FOREIGN PATENT DOCUMENTS

| | | | |
|---|---|---|---|
| 497521 | 12/1950 | Belgium | 34/100 |
| 2947950 | 7/1981 | Germany | 219/222 |
| 3738968 | 9/1988 | Germany | 132/212 |
| 87-17038 | 11/1988 | Germany . | |
| 3800954 | 4/1989 | Germany | 132/212 |
| 641622 | 8/1950 | United Kingdom | 34/100 |
| 1030172 | 5/1966 | United Kingdom | 392/380 |

*Primary Examiner*—John A. Jeffery
*Attorney, Agent, or Firm*—Jones, Tullar & Cooper

[57] ABSTRACT

A hairdressing device comprises a hand held unit, a blower assembly, a hose and a warm-air line. The hand held unit includes a cylindrical hair roller defining an axis of rotation and having a plurality of openings, a motor for rotatably driving the hair roller about its axis of rotation, and a nozzle through which air is blown against the hair roller in a direction perpendicular to the hair roller axis of rotation. The blower assembly includes a blower housing and a blower including a motor disposed in the blower housing. The hose connects the hand held unit to the blower such that air is drawn by the blower through the plurality of openings in the hair roller, the hose and into the housing, from which the drawn air exits. The warm-air line connects the hand held unit to the blower housing, such that air aspirated by the blower to cool the blower motor is delivered as warm-air through the warm-air line to the nozzle.

18 Claims, 2 Drawing Sheets

HAIRDRESSING DEVICE WITH FIRST AND SECOND BLOWERS

CROSS REFERENCE TO RELATED APPLICATION

07/725,486, filed as PCT/EP90/00355, Mar. 3, 1990, published as WO90/10399, Sep. 20, 1990, and now abandoned.

BACKGROUND OF THE INVENTION

The present invention relates to a hairdressing device having a hand unit, which has a cylindrical hair roller driven to rotate by a motor and a hot-air nozzle blowing at the hair roller at right angles to the axis of rotation of the hair roller, in which negative pressure prevails at intake openings of the cylindrical hair roller, the negative pressure being generated by a blower that is disposed in a blower housing and communicates with the hand unit via a hose. The air aspirated by the blower via the intake openings of the cylindrical hair roller, flowing through the blower housing and then flows out of the blower housing.

A hairdressing device of this type is known (EP-B1-0 052 325, DE-U-87 17 038.8). In the device disclosed in this patent, cooling of the blower motor is provided by the air flow entering the blower housing via the hose and exiting from it into the surroundings of the blower housing via suitable outlet openings of the blower housing. The negative pressure required to apply a hair or a strand of hair to the surface of the rotating cylindrical hair roller in the known hairdressing device is accordingly generated in a manner similar to that of a vacuum cleaner. To dry the hair applied to or wound on the surface of the cylindrical hair roller, air is aspirated from the surroundings through intake slits provided in the housing of the hand unit, by means of a further blower provided in the hand unit, and this air is carried to the hot-air nozzle via suitable air heaters. The known device has the disadvantage that the necessary separation between the negative pressure air loop and the drying air loop, required for effective drying, makes for a complicated construction of the known hairdressing device. A blower in the hand unit is necessary to supply air to the hot-air nozzle, and its additional weight makes the hand unit harder to manipulate. The persons whose hair is being dressed are exposed to constant noise, which impairs their comfort considerably.

German Patent 37 38 968 discloses a hairdressing device in which a closed air loop is provided between the intake openings of a rotatable hollow body and a blow-out nozzle with air blow-out slits, blowing vertically against the hollow body. The air aspirated via the suction openings of the hollow body is carried via a flexible hose to the suction side of a central unit. A radial fan carries the air, delivered to the suction side of the central unit, via the hose, to the compression side of the central unit. This side has outlet connection pieces, in each of which an air heater is disposed. The air, heated in the air heaters, is supplied via a further hose to the air blow-out slits of the blow- out nozzle. This known hairdressing unit has the disadvantage that it has a single self-contained air loop. The moisture given up by the hair applied to the hollow body reaches the central unit, via the suction openings and the flexible hose, and is heated by the air heaters in the central unit. Via the blow-out nozzle, the resultant warm, moist air is then blown back on to the hair to be dried. A closed air loop of this kind rapidly becomes saturated with moisture, so that no further drying action can take place.

SUMMARY OF THE INVENTION

An object of the present invention is to improve the handling and ease of use of the noted hairdressing unit, specifically, by providing that the hand unit used is lighter and easier to handle, and that the noise irritation to the person whose hair is being dressed, caused by the motor from the hot-air nozzle provided in the hand unit, is eliminated. Another object of the present invention is also to assure that the air used for drying not become saturated with moisture in the hairdressing device according to the present invention.

According to the present invention, these objects are attained in that an air flow, aspirated by the blower in the blower housing from the surroundings of the blower housing and used to cool the blower motor, is then delivered via a warm-air line to the hot-air nozzle provided in the hand unit.

A hairdressing device of this type has the following advantages:

(a) The motor for the hair dryer (air supply to the hot-air nozzle) is eliminated from the hand unit, so that the hand unit becomes lighter.

(b) The noise irritation from the hair dryer motor, which in the prior art is provided in the hand unit, is eliminated. This problem was especially serious, because for the sake of lighter weight, motors had to be used at high speed, which in turn caused especially annoying, loud noise.

(c) Hair dryers of this type (high rpm with a view to the desired saving in weight) were also unsuitable for professional use because of their high vulnerability to trouble from wear and from dust accumulation. Because they are now dispensed with entirely, the entire device becomes more reliable.

(d) The energy required becomes substantially less, because the cooling air for the blower motor in the blower housing is now made further use of, namely to supply the hot-air nozzle in the hand unit.

(e) By disposing the motor for the cylindrical hair roller on the side of the hand unit remote from the hose connection, better equalization of weight and thus better handling are attained.

(f) The hand unit can be made shorter; this provides for a further weight reduction and also makes the unit especially useful, for instance in the neck region of hairstyles. The hand grip can be made more ergonomic, because the hollow shaft and thus the requirement for a tubular, round shape in this region are omitted.

(g) The countercurrent air flows in a hose within a hose making one-handed operation possible.

(h) The power savings compared with known devices are approximately 30%; the weight saving for the hand unit is approximately 200 g.

BRIEF DESCRIPTION OF THE DRAWINGS

An exemplary embodiment of the present invention and its advantageous further features will be described below, referring to the accompanying drawings. Shown are.

DETAILED DESCRIPTION OF A PREFERRED EMBODIMENT

Figure 1:
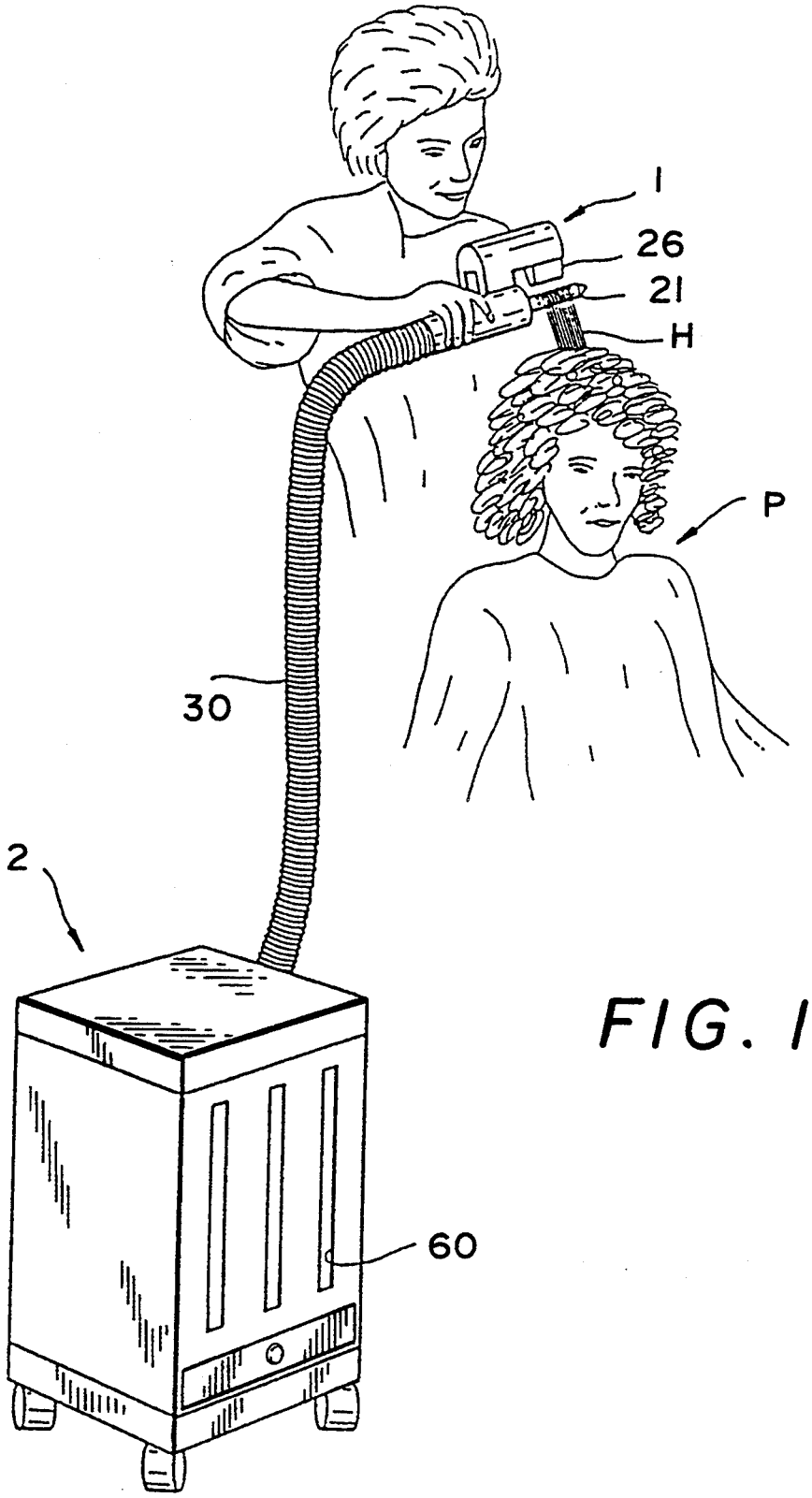
FIG. 1, which is a schematic view of the hairdressing device.

FIG. 1 shows a styling and hairdressing device that is embodied by a hand unit 1 and a blower housing 2. A hairdresser manipulates the hand unit in order to roll up individual strands H of hair of a person P, shape them, dehumidify them and dry them.

Figure 2:
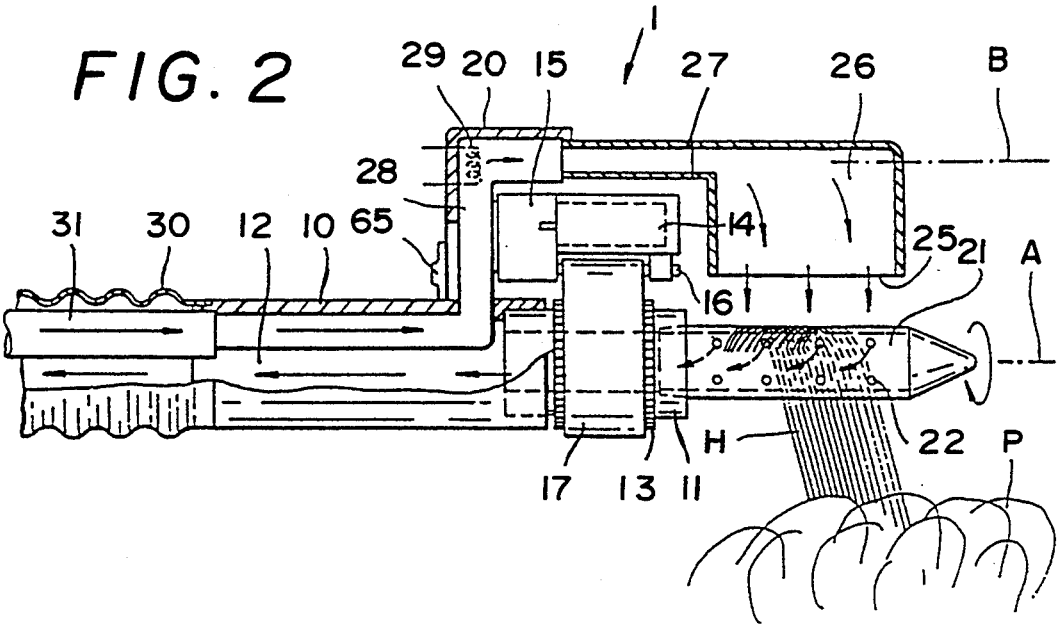
FIG. 2, which is the hand unit.
Figure 3:
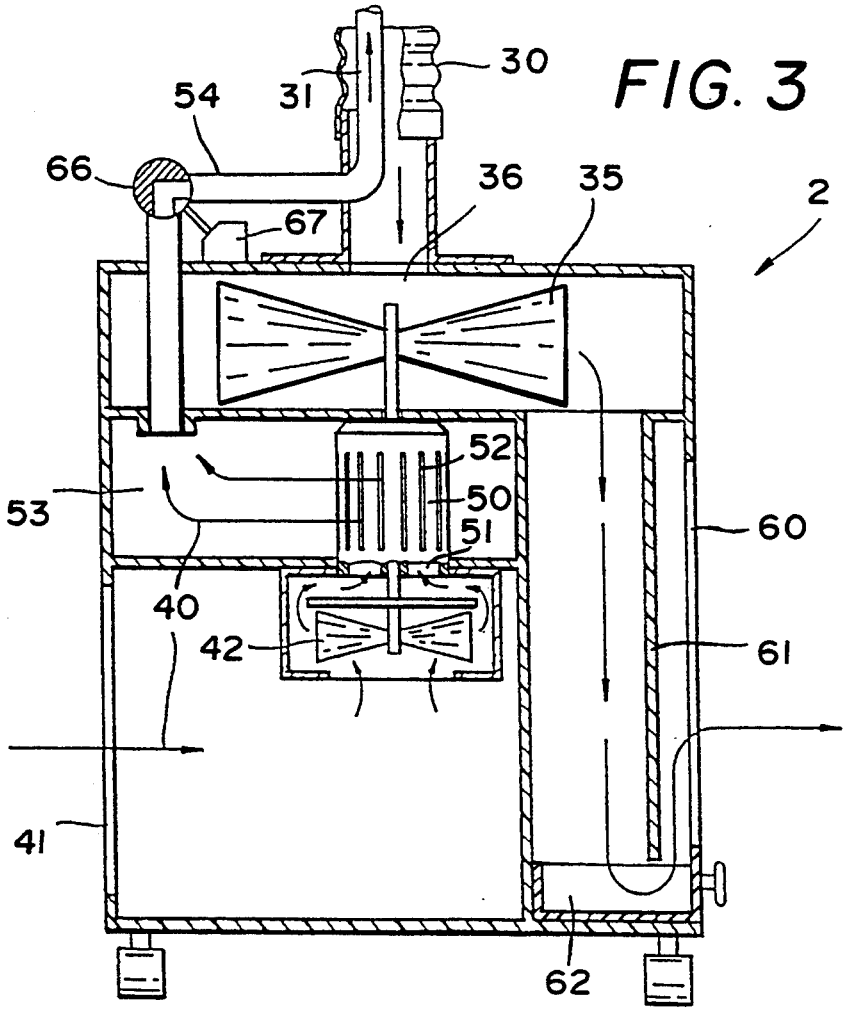
FIG. 3, which is the blower housing.

As can be seen from FIG. 2, the hand unit 1 has a hand grip 10, through the interior of which an air guide conduit 12 extends. A hollow shaft 11 is rotatably supported on the right-hand end in the handle 10. Mounted on the hollow shaft 11 is a gear wheel 13, which is driven by a motor 14. The motor 14 is flanged to a transmission 15 and drives the shaft 16, which by means of a toothed belt 17 drives the gear wheel 13 and thus the hollow shaft 11. The unit formed of the motor 14 and transmission 15 is disposed in a housing 20, which is joined to the hand grip 10. A cylindrical hair roller 21 is mounted at the right-hand end of the hollow shaft 11; it is closed at the front but is provided with openings 22 and rotates with the hollow shaft 11.

The outlet opening 25 of a hot-air nozzle 26 is disposed along the cylindrical hair roller 21, covering the longitudinal region thereof that is provided with the openings 22. Hot air exiting from the outlet opening 25 flows out at right angles to the axis A of the cylindrical hair roller 21. The hot-air nozzle 26 is pivotably connected to the air conduit 27 such that it is tiltable about the axis B; the air conduit 27 is disposed on the housing 20.

The heating wire 29 is located in the warm-air line 28, which is introduced into the hand grip 10 inside the housing 20 and from which the heated air then passes to the air conduit 27 and from there into the hot-air nozzle 26.

Arranging the heating wire 29 far away from the outlet opening 25 of the hot-air nozzle 26 in the flow direction makes for thorough mixing of the hot air. Thus it also becomes possible to embody the hot-air nozzle in two parts, so that it can be easily taken apart for cleaning. The two part division is not shown in the drawing; however, it may advantageously be done along the center plane of the hot-air nozzle 26 that extends parallel to the plane of the drawing. The capability for dismantling is gained by the disposition of the heating wire 29 as described, because in that case, even if the hot-air nozzle is dismantled, there is no danger from contact and/or from the heating wire 29.

The air guide conduit 12 in the hand grip 10 communicates with a hose 30. The warm-air line 28 communicates with a further hose 31 that has a smaller cross section. The hose 31 extends inside the hose 30.

In the blower housing 2, negative pressure (vacuum) is generated by a blower 35 in the chamber 36, which communicates with the hose 30. This negative pressure is propagated via the hose 30, the air guide conduit 12 in the hand grip 10, the interior of the hollow shaft 11, and on into the interior of the cylindrical hair roller 21, so that it becomes effective at the openings 22. At the same time, initially heated air is delivered via the hose 31 and the warm-air line 28 to the hot-air conduit 27 and is there heated by the heating wire 29. The hot air then exits through the hot-air nozzle 26.

The function of the device is such that a strand H of hair of a person P is picked up and rolled up by the negative pressure acting at the openings 22 of the cylindrical hair roller 21, which is otherwise smooth on the outside. In the rolled-up state, the cylindrical hair roller 21 continues to rotate while the hair slides on it. At the same time, the hair experiences a flow from the hot-air nozzle 26. In this process, air is removed by suction via the interior of the cylindrical hair roller 21 and the openings 22. The hair can be rolled up, dehumidified, dried and shaped very rapidly in this way.

The initial heating or preheating of the warm air, which reaches the hot-air conduit 27 via the hose 31 and warm-air line 28, is effected by means of an air flow 40 that enters the blower housing 2 through slits 41 and is forced by a paddle wheel 42 for cooling the blower motor 50 into the cooling air inlet slits 51 provided on the underside of the blower motor. This air flow then flows around the part of the blower motor 50 that heats up during operation and emerges through its cooling air outlet slits 52 into the chamber 53 to which the warm-air line 28 is connected. The particular idea that the present invention makes use of is to use the air that heats or is heated in the cooling of the blower motor 50 in the blower housing 2 for the hair dryer embodied by the heater 29 and hot-air nozzle 26, so that the hair dryer itself no longer needs a blower, and its heater can also be more economical in size, since the air has already undergone a certain preheating by cooling the blower motor 50.

The blower 35 for generating a negative pressure in the chamber 36 and thus in the hose 30 is likewise embodied by a paddle wheel. The air flow removed by suction exits from the blower housing 2 via slits 60; the air flow is forced before that to flow around an upright air guide baffle 61, so that moisture can be precipitated; the condensed water drips into a condensed water collecting container 62 that can be pushed like a drawer into the lower region of the blower housing 2.

As can be seen, in FIG. 2 the components comprising the motor 14, transmission 15 and hollow shaft 11 are located at one end of the hand grip 10, while the hose 30 is secured to the other. The result is accordingly—looking at the hand unit 1 by itself—a certain excess weight on the right-hand side in FIG. 2, which counteracts the weight of the hose 30 on the other side.

As already mentioned, the hose 31 for the warm air is guided inside the hose 30 through which the air that has passed through the strands H of hair in the openings 22 is removed by suction. This air removed by suction has previously been expelled by the hot-air nozzle 26, however, so that even if it is already located in the hose 30 and from there is aspirated into the blower housing 2, it still has a certain temperature. This temperature is higher than that of the air carried to the hand unit 1 in the hose 31. Accordingly, a heat exchange still continues to take place in the hose 30, specifically because the hot air flowing in the hose 30 to the blower housing 2 still gives up heat, by the countercurrent principle, to the preheated air in the hose 31 flowing in the opposite direction.

The preheating by the blower motor 50 of the air output by the hot-air nozzle 26 can correspond to the first heating stage of the hot-air nozzle, while if the heating wire 29 is added the second heating stage is switched on. This makes for economy in terms of equipment.

The cold operation of the cylindrical hair roller results once the heating wire 29 is switched off and a valve 66 in the line 54 is rotated 90° counterclockwise, actuated by a control motor 67. The motor cooling air in the blower housing is then blown out into the open.

Rolling the hair up on the hand unit and shaping it is done without blow drying. The switching of the control motor 67 takes place together with the shutoff of the heating wire 29 in a suitable position of the multifunction key 65, which is also used to set the other operating conditions; the electric line leads from the multifunction key 65 to the control motor 67 through the hose 31, which carries dry air that is also cooler in comparison with the air in the hose 30.

What is claimed is:

1. A hairdressing device, comprising:

a hand held unit having an elongated hair roller, said elongated hair roller defining an elongated axis of rotation and having a plurality of suction air intake openings situated about said elongated axis of rotation and a suction outlet, means defining a nozzle through which heated air is ejected in a direction toward said elongated hair roller, and a motor connected to said elongated hair roller for rotating said elongated hair roller about said elongated axis of rotation;

a blower assembly including a blower housing, having a first opening and a second opening, and having mounted therein a first blower and a second blower, first means connecting said first blower to said suction outlet and providing a suction pressure at said plurality of suction intake openings which thereby generates an air flow from the air surrounding said hand held unit, which flows from said plurality of suction intake openings to said housing and outwardly from said first opening, and second means connecting said second blower to said nozzle and generating an air flow inwardly from the air outside of said second opening of said blower housing, which flows from said second opening of said blower housing to said nozzle of said hand held unit, and means for maintaining the air flow generated by said first blower separate from the air flow generated by said second blower;

said first connecting means comprising a hose connecting the hand held unit to said blower housing;

said second connecting means comprising a warm air line connecting the hand held unit to said blower housing; and valve means situated in said warm air line, wherein the air flow generated by said second blower is heated by heat produced incidental to operation of said first and second blowers in said blower housing, said heated air being delivered through said warm air line to said nozzle of said hand held unit, and said valve means is connected such that atmospheric air is supplied to said nozzle and said warm air line is disconnected from said blower housing.

2. The hairdressing device as defined in claim 1, wherein the hand held unit further includes a hand grip with said hose being connected to the hand held unit on one side of said hand grip, and the motor for rotatably driving said hair roller being disposed in the hand held unit on the opposite side of said hand grip.

3. The hairdressing device as defined in claim 1, wherein the warm-air line is disposed partly within said hose.

4. The hairdressing device as defined in claim 3, wherein the hand held unit further includes a hand grip with said hose being connected to the hand held unit on one side of said hand grip, and the motor for rotatably driving said hair roller being disposed in the hand held unit on the opposite side of said hand grip.

5. The hairdressing device as defined in claim 1, wherein said hand held unit further having a heater connected to said warm-air line for further heating the warm-air prior to flowing through said nozzle.

6. The hairdressing device as defined in claim 1, wherein said means defining a nozzle being tiltable about an axis extending substantially parallel to said elongated axis of rotation.

7. A hairdressing device, comprising:

a hand held unit having an elongated hair roller, said elongated hair roller defining an elongated axis of rotation and having a plurality of suction air intake openings situated about said elongated axis of rotation and a suction outlet, means defining a nozzle through which heated air is ejected in a direction toward said elongated hair roller, and a motor connected to said elongated hair roller for rotating said elongated hair roller about said elongated axis of rotation;

a blower assembly including a blower housing having a first opening and a second opening, and having mounted therein a further motor, a first blower and a second blower at least one of which is driven by said further motor, said first blower adapted to be connected to said suction outlet for providing a suction pressure at said plurality of suction intake openings which thereby generates an air flow from the air surrounding said hand held unit, which flows from said plurality of suction intake openings to said housing and outwardly from said first opening, and said second blower adapted to be connected to said nozzle for generating an air flow inwardly from the air outside of said second opening of said blower housing, which flows from said second opening of said blower housing to said nozzle of said hand held unit, and means for maintaining the air flow generated by said first blower separate from the air flow generated by said second blower;

a hose connecting said suction outlet of the hand held unit to suction pressure provided in said blower housing by said first blower;

a warm air line connecting said nozzle of the hand held unit to the air flow generated in said blower housing by said second blower; and valve means situated in said warm air line, wherein the air flow generated by said second blower is led to said further motor to cool said further motor thereby heating the air flow generated by said second blower, and delivering through said warm air line said heated air to said nozzle of said hand held unit, and said valve means is connected such that atmospheric air is supplied to said nozzle and said warm air line is disconnected from said blower housing.

8. The hairdressing device as defined in claim 7, wherein the hand held unit further includes a hand grip with said hose being connected to the hand held unit on one side of said hand grip, and the motor for rotatably driving said hair roller being disposed in the hand held unit on the opposite side of said hand grip.

9. The hairdressing device as defined in claim 7, wherein the warm-air line is disposed partly within said hose.

10. The hairdressing device as defined in claim 9, wherein the hand held unit further includes a hand grip with said hose being connected to the hand held unit on one side of said hand grip, and the motor for rotatably driving said hair roller being disposed in the hand held unit on the opposite side of said hand grip.

11. The hairdressing device as defined in claim 7, wherein the hand held unit further includes a heater connected to said warm-air line for further heating the warm-air prior to flowing through said nozzle.

12. The hairdressing device as defined in claim 7, wherein said means defining a nozzle being tiltable about an axis extending substantially parallel to said elongated axis of rotation.

13. A hairdressing device, comprising:

a hand held unit having an elongated hair roller, said elongated hair roller defining an elongated axis of rotation and having a plurality of suction air intake openings situated about said elongated axis of rotation and a suction outlet, means defining a nozzle through which heated air is ejected in a direction toward said elongated hair roller, and a motor connected to said elongated hair roller for rotating said elongated hair roller about said elongated axis of rotation;

a blower assembly including a blower housing, having a first opening and a second opening, and having mounted therein a further motor, a first blower and a second blower at least one of which is driven by said further motor, said first blower adapted to be connected to said suction outlet for providing a suction pressure at said plurality of suction intake openings which thereby generates an air flow from the air surrounding said hand held unit, which is adapted to flow from said plurality of suction intake openings to said housing and outwardly from said first opening, and said second blower adapted to be connected to said nozzle for generating an air flow inwardly from the air outside of said second opening of said blower housing, which is adapted to flow from said second opening of said blower housing to said nozzle of said hand held unit, and means for maintaining the air flow generated by said first blower separate from the air flow generated by said second blower, wherein the air flow generated by said second blower is heated by heat produced incidental to operation of said further motor and said heated air is delivered through a warm air line to said nozzle of said hand held unit;

a hose connecting the suction outlet of the hand held unit to the air flow generated by said first blower in said blower housing;

a warm air line connecting the means defining the nozzle of the hand held unit to the air flow generated by said second blower in said blower housing;

means for preventing air being ejected from said means defining the nozzle onto said elongated hair roller; and valve means situated in said warm air line, wherein said valve means is connected such that atmospheric air is supplied to said nozzle and said warm air line is disconnected from said blower housing.

14. The hairdressing device as defined in claim 13, wherein the hand held unit further includes a hand grip with said hose being connected to the hand held unit on one side of said hand grip, and the motor for rotatably driving said hair roller being disposed in the hand held unit on the opposite side of said hand grip.

15. The hairdressing device as defined in claim 13, wherein the warm-air line is disposed partly within said hose.

16. The hairdressing device as defined in claim 15, wherein the hand held unit further includes a hand grip with said hose being connected to the hand held unit on one side of said hand grip, and the motor for rotatably driving said hair roller being disposed in the hand held unit on the opposite side of said hand grip.

17. The hairdressing device as defined in claim 13, wherein the hand held unit further includes a heater connected to said warm-air line for further heating the warm-air prior to flowing through said nozzle.

18. The hairdressing device as defined in claim 13, wherein said meads for preventing air being ejected from said means defining a nozzle onto said elongated hair roller further comprises switching means being arranged in the hand held unit.

* * * * *